United States Patent [19]

Herbers et al.

[11] 4,328,845

[45] May 11, 1982

[54] LOG SPLITTER

[75] Inventors: Gregory J. Herbers, Blue Grass; Wendell C. Hunt, Ottumwa; Brian G. Moriarity, Mason City, all of Iowa

[73] Assignee: Iowa State University Research Foundation, Inc., Ames, Iowa

[21] Appl. No.: 219,324

[22] Filed: Dec. 22, 1980

[51] Int. Cl.[3] ..... B27L 7/00

[52] U.S. Cl. ..... 144/193 A

[58] Field of Search ..... 144/193 R, 193 A; 254/93 R, 122, 124; 125/23 R

[56] References Cited

U.S. PATENT DOCUMENTS

| | | | |
|---|---|---|---|
| 3,077,214 | 2/1963 | Brukner | 144/193 A |
| 3,937,260 | 2/1976 | Anderson | 144/193 A |
| 4,076,062 | 2/1978 | Kanik | 144/193 A |
| 4,103,724 | 8/1978 | Braid | 144/193 A |
| 4,153,088 | 5/1979 | King et al. | 144/193 A |

*Primary Examiner*—W. D. Bray

*Attorney, Agent, or Firm*—Zarley, McKee, Thomte, Voorhees & Sease

[57] ABSTRACT

The log splitter of the present invention comprises a frame having a wedge fixed thereon. A slidable ram is mounted on the frame for longitudinal sliding movement toward and away from the wedge. A ram rod is connected to the ram and is further connected to a parallelogram toggle mechanism having one of its four corners fixed to the frame. As the toggle mechanism expands and contracts it causes the ram to move toward and away from the wedge. Hydraulic power means are connected to the toggle linkage for causing it to expand and contract.

7 Claims, 5 Drawing Figures

LOG SPLITTER

BACKGROUND OF THE INVENTION

This invention relates to log splitters. Presently known power log splitters are two general types. One of these is the hydraulic wedge type splitter and the other is the screw type splitter. The hydraulic wedge employs a hydraulic cylinder that forces the log through a wedge so as to cause it to split. By the use of hydraulics, large forces can be obtained.

The screw type log splitter utilizes a threaded cone that screws itself into the log. The widening base of the cone prys the log apart.

Present log splitters have several disadvantages. The screw type log splitter is inherently unsafe to operate and is imprecise in splitting, although it is relatively inexpensive. The hydraulic wedge type splitter is usually large and bulky, has long work cycles, and is inherently unsafe.

Therefore, a primary object of the present invention is the provision of an improved log splitter which is less bulky, has a shorter work cycle and is safer than prior art devices.

A further object of the present invention is the provision of a device which uses less power than in prior devices.

A further object of the present invention is the provision of a device which decreases the work cycle, thus increasing the time efficiency for splitting logs.

A further object of the present invention is the provision of a device which has improved safety.

A further object of the present invention is the provision of a device which is easily adaptable for various log sizes.

A further object of the present invention is the provision of a device which is compact and which is efficient in its use of component placement.

A further object of the present invention is the provision of a device which provides a high initial force at the beginning of its cycle and which provides a lower force and higher velocity towards the end of its cycle so as to speed up the log splitting process.

A further object of the present invention is the provision of a device which is attractive in appearance and which requires a low amount of maintenance.

SUMMARY OF THE INVENTION

The present invention utilizes a sliding ram which is spaced from a fixed wedge. The ram forces the log against the wedge to split the log in much the same fashion as presently found in hydraulic log splitters.

However, in order to move the ram towards the wedge, the present invention utilizes a four member toggle linkage in the shape of a collapsible parallelogram. The toggle linkage has one of its four pivotal corners fixed to the splitter frame, the other three corners being free to move. Hydraulic cylinders are used to expand and retract the linkage. A ram rod is connected at one end to the sliding ram, and at the other end to the corner of the toggle parallelogram which is opposite from the fixed corner. Thus, as the toggle linkage collapses and expands, it causes reciprocating sliding movement of the ram.

The toggle linkage provides maximum force to the ram during the initial splitting action. However, after the initial movement of the ram, the velocity is increased and the force is decreased. This permits the ram to complete its cycle faster after the initial splitting action of the log is achieved. It has been found that the greatest force for splitting the log is required initially, and that the force required for further splitting the log diminishes after the initial splitting action.

DETAILED DESCRIPTION OF THE INVENTION

Figures 1, 2, 3, 4, 5, 6:
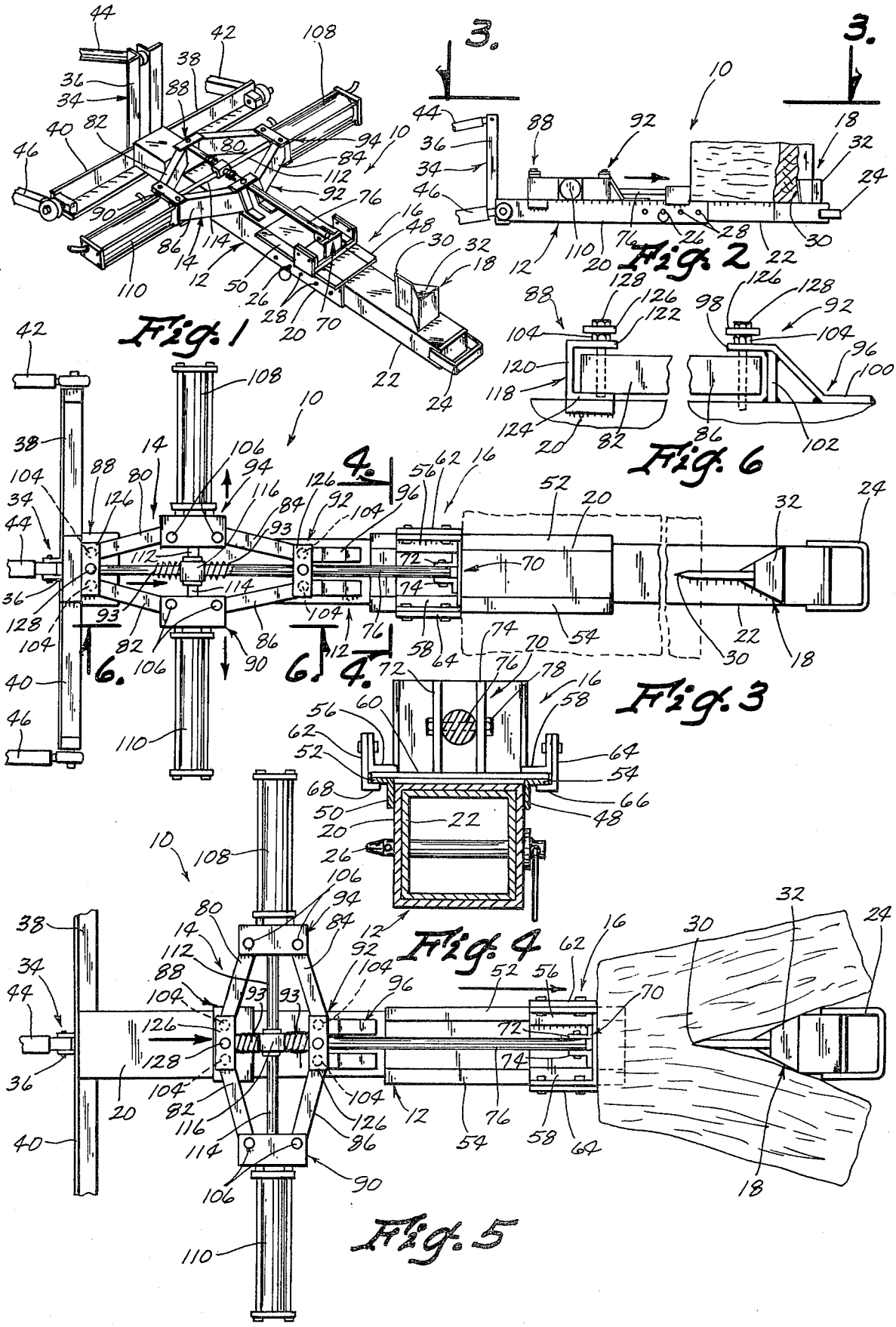
FIG. 1 is a perspective view of the log splitting device.
FIG. 2 is a side elevational view of the log splitting device in FIG. 1.
FIG. 3 is a plan view of the device shown in FIG. 1.
FIG. 4 is a sectional view taken along line 4—4 of FIG. 3.
FIG. 5 is a plan view similar to FIG. 3, but showing the device in the midst of its log splitting cycle.
FIG. 6 is a sectional view taken along line 6—6 of FIG. 3.

Referring to the drawings, the numeral 10 generally designates the log splitter of the present invention. Device 10 comprises a frame assembly 12, a toggle mechanism 14, a slidable ram assembly 16, and a wedge 18.

Frame assembly 12 includes a longitudinal channel frame member 20 which is rectangular in cross-section as can be seen in FIG. 4. Telescopically mounted within channel 20 is a channel extension 22 having a handle 24 mounted on the outer end thereof. Extension 22 is telescopically slidable within channel frame member 20 and can be locked in a plurality of positions by means of a lock pin 26, which can be inserted through a plurality of locking holes 28 within channel 20 and extension 22.

Wedge 18 is secured to the upper surface of channel extension 22 and includes a cutting edge 30 and a spreading wedge 32.

At the forward end of channel frame member 20 is a T-frame 34 having a vertical frame member 36, and two horizontal frame members 38, 40 adapted to receive a three point hitch from a conventional tractor. The three point hitch is designated by the numerals 42, 44, 46 in FIG. 1.

Mounted on the upper, outer edges of frame 20 are a pair of angle members 48, 50 which are parallel to one another and which provide horizontally extending lips 52, 54.

Ram assembly 16 comprises a U-shaped frame formed by two angle members 56, 58 welded to a transverse web 60. Bolted to the vertical sides of angle members 56 are a pair of L-shaped members 62, 64, having inwardly extending lips 66, 68 which embrace the undersurfaces of lips 52, 54 so as to lock ram assembly 16 to channel frame member 20 for longitudinal sliding movement thereon. A clevis 70 is welded to the upper surface of web 60 and includes a pair of spaced apart clevis flanges 72, 74. A ram rod 76 is pivotally mounted between flanges 72, 74 by means of a locking pin or bolt 78.

Toggle mechanism 14 comprises four toggle links 80, 82, 84, 86 which are joined into a parallelogram by four hinges 88, 90, 92, 94. Hinge 92 is the only one of the four hinges which is fixed to frame 20, the other hinges 88, 90 and 94 being free to move with respect to frame 20. Hinge 92 comprises a pair of Z-shaped angles 96 (FIG. 6), each having an upper horizontal portion 98 spaced above frame 20 and a lower horizontal portion 100 welded to frame 20. A strut member 102 provides vertical support so as to hold upper horizontal portion 98 spaced above frame 20. A pair of pivot pins 104 extend through upper horizontal portion 98 and downwardly through hinge holes in toggle links 84, 86 so as to pivotally connect toggle links 84, 86 to hinge 92 for pivotal movement about pins 104.

Hinges 90, 94 are constructed in a fashion identical to one another, and include pins 106 for pivotally connecting toggle links 80, 84 to one another, and toggle links 82, 86 to one another. The hydraulic cylinder 108 is mounted to hinge 94, and a hydraulic cylinder 110 is mounted to hinge 90. Cylinders 108, 110 include cylinder rods 112, 114 respectively, which extend inwardly toward the center of the parallelogram formed by toggle links 80, 82, 84, 86. The inner ends of cylinder rods 112, 114 are attached to a slide block 116. Slide block 116 is in the shape of a cylindrical collar which has a longitudinal bore extending therethrough and which is slidably mounted on ram rod 76. Thus, ram rod 76 is free to slide longitudinally through slide block 116. The end of ram rod 76 opposite from ram assembly 16 is attached to hinge 88 by means (not shown) so that movement of hinge 88 causes ram assembly 16 to slide on rails 52, 54. Extension and retraction of cylinders 108, 110 causes the toggle linkage to move between the positions shown in FIG. 3 and the positions shown in FIG. 5.

Hinge 88 is similar in construction to hinge 92 with the exception that hinge 88 is free to move longitudinally along the upper surface of frame member 20. As can be seen in FIG. 6, hinge 88 includes a U-shaped channel 118 having a vertical portion 120, an upper horizontal portion 122 and a lower horizontal portion 124. Lower horizontal portion 124 is adapted to slide along the upper surface of longitudinal channel member 20. A pair of pivot pins 104 pivotally mount toggle links 80–82 to hinge 88 in a fashion similar to the pivotal mounting of toggles 84, 86 to hinge 92.

In order to hold pins 104 in place within hinges 88, 92, a cap plate 126 is bolted by a bolt 128 to hinges 88, 92 in covering relation over the upper ends of pins 104 as can be seen in FIGS. 3, 5 and 6.

In operation, cylinders 108, 110 are moved to their fully retracted position so that the toggle linkage 14 is collapsed to the position shown in FIG. 3. In this position, ram assembly 16 is moved to its fully retracted position at its farthest distance from cutting edge 30 of wedge 18. A log L is positioned between ram assembly 16 and cutting edge 30 of wedge 18.

Cylinders 108, 110 are then actuated to begin extending cylinder rods 112, 114. This causes hinges 90, 94 to begin moving away from one another, and causes hinge 88 to begin moving toward fixed hinge 92. Because ram rod 76 is connected to hinge 88, it is forced to the right as seen in FIGS. 3 and 5, thereby forcing the ram assembly 16 toward wedge 18. During the initial movement of the linkage mechanism 14 from its position shown in FIG. 3, there is a maximum force applied to ram assembly 16. As the linkage mechanism moves closer and closer to the position shown in FIG. 5, the force applied to ram assembly 16 is diminished, but the velocity with which assembly 16 moves is increased. In the splitting of the log, it has been found that the greatest force is needed to begin the splitting action, but that after the splitting action has begun, a lesser force is required. In prior art hydraulic devices, the force is kept constant, as is the velocity of the ram. Thus, the time necessary to complete the cycle is greater in prior art devices. In contrast, the present invention, after making the initial splitting action, increases in velocity and completes the stroke much more quickly than in prior art devices.

In FIG. 5, the toggle linkage is shown in a position just short of its fully extended position. In the fully extended position, toggle links 80, 82, 84, 86 approach being parallel with one another. In order to insure that links 80, 82, 84, 86 will return from this extended position towards the collapsed position of FIG. 3, a pair of springs 93 are provided. These springs 93 are compressed when the toggle linkage is in its extended position and therefore cause hinges 88, 92 to be spring biased away from one another. This spring bias helps hinge 88, 92 to begin moving apart when cylinder rods 112, 114 start retracting.

Thus, by incorporation of the toggle mechanism, the present invention accomplishes the stated objectives. It decreases the time necessary for the work cycle, and it accomplishes this by the increase in ram speed as it completes its stroke. Also because of the mechanical advantage gained with the toggle, smaller hydraulic cylinders may be utilized than those in previous devices.

The device includes several advantages which provide safety. Often with prior art devices, the operator has tried to pull the log apart after its initial splitting, rather than wait for the slow movement of the ram to complete the splitting process. With the present invention, the device speeds up after initially splitting the log, thereby eliminating the necessity for the operator to try and split the log with his hands.

Because of the extensibility of frame extension 22, the device can be adjusted to accommodate logs of various sizes.

This adjustability allows the maximum splitting forces to be developed for the initial split, independent of the log length. The extensibility of frame extension 22 mated with the toggle mechanism's large initial splitting forces, makes it easier for the removal of "jammed" logs than with conventional log splitters.

If, during the course of splitting a log, the hydraulic system is unable to develop enough force to complete the split and the log becomes "jammed" on the wedge, then the slidable ram 16 can be returned to its start position and frame extension 22 can be moved, along with the unsplit log toward the slidable ram assembly. The splitting cycle can then be repeated with its initial high forces, and complete the split.

With current log splitters, if power is insufficient to complete the split and the log is "jammed", the log must be manually pryed off the wedge. This leads both to time loss and an increase in the possibility of an injury to the operator.

The device is compact and provides efficient use of component placement. It can easily be connected to the hydraulic system of a conventional tractor and requires a minimum of maintenance.

What is claimed is:

1. A log splitting device comprising:

a frame having opposite ends;

a wedge means fixed to one of said opposite ends of said frame;

a ram means mounted on said frame for sliding longitudinal movement from a first position spaced from said wedge means to a second position closer to said wedge means;

a ram rod operatively connected to said ram means;

toggle mechanism connected to said ram rod and said frame, said toggle mechanism having at least two toggle links pivotally connected to one another, and being movable from a collapsed position wherein said toggle mechanism holds said ram means in said first position to an expanded position wherein said toggle mechanism moves said ram means to said second position; and power means connected to said toggle links for causing them to move between said collapsed and expanded positions.

2. A log splitting device according to claim 1 comprising stationary hinge means fixed to said frame and pivotally connected to one end of each of said two toggle links for providing said pivotal connection therebetween, said power means being connected between the opposite ends of said two toggle links, a second linkage mechanism interconnecting said opposite ends of said two toggle links, said rod being connected to said second linkage mechanism.

3. A log splitting device according to claim 2 wherein said second linkage mechanism comprises third and fourth toggle links pivotally connected to each other and pivotally connected to said opposite ends of first mentioned two toggle links whereby said first two toggle links and said third and fourth toggle links form a collapsible parallelogram.

4. A log splitting device according to claim 3 wherein a slide hinge pivotally interconnects said third and fourth toggle links, said slide hinge being mounted for sliding movement on said frame toward and away from said hinge means interconnecting said first two toggle links, whereby said slide hinge moves toward and away from said hinge means in response to expansion and collapsing of said first two toggle links.

5. A log splitting device according to claim 4 wherein said power means comprise first and second hydraulic cylinders, each of which is connected to one of said opposite ends of said first two toggle links, said cylinders each having an extendible cylinder rod extending inwardly to the approximate center of said parallelogram, connecting means interconnecting said cylinder rods whereby extension of said cylinder rods moves said first toggle links to said expanded position and retraction of said cylinder rods moves said first two toggle links to said collapsed position.

6. A log splitting device according to claim 5 wherein said connecting means includes a slide collar having a cylindrical bore extending therethrough, said ram rod extending slidably through said connecting means and being operatively connected to said slide hinge.

7. A log splitting device according to claim 1 wherein said toggle mechanism further comprises third and fourth toggle links, stationary hinge means connected to said frame and pivotally connecting one end of one of said first mentioned two toggle links to one end of the other of said first mentioned two toggle links, a pair of side hinge means, each pivotally connecting one end of one of said third and fourth toggle links to the other end of one of said first two toggle links and said third and fourth toggle links to form a collapsible parallelogram which is movable from an expanded position shaped in an approximate rectangle to a collapsed position, said sliding hinge means being movable towards and away from said wedge means as said parallelogram moves between said expanded and collapsed positions.

* * * * *